US005520245A

United States Patent [19]

Estes

[11] Patent Number: 5,520,245

[45] Date of Patent: May 28, 1996

[54] DEVICE TO DETERMINE FREE POINT

[76] Inventor: James D. Estes, 6010 English Oak Dr., Arlington, Tex. 76016

[21] Appl. No.: 334,518

[22] Filed: Nov. 4, 1994

[51] Int. Cl.[6] ..... E21B 31/00

[52] U.S. Cl. ..... 166/66; 73/151

[58] Field of Search ..... 166/65.1, 66, 255; 73/151

[56] References Cited

U.S. PATENT DOCUMENTS

| | | | |
|---|---|---|---|
| 2,530,309 | 11/1950 | Martin | 73/151 |
| 2,550,964 | 5/1951 | Brookes | 73/151 |
| 3,004,427 | 10/1961 | Berry | 73/151 |
| 3,153,339 | 10/1964 | Alexander et al. | 73/151 |
| 3,233,170 | 2/1966 | Rogers | 324/34 |
| 3,686,943 | 8/1972 | Smith | 73/151 |
| 3,934,466 | 1/1976 | Curry | 73/151 |
| 3,942,373 | 3/1976 | Rogers | 73/151 |
| 4,105,071 | 8/1978 | Nicolas et al. | 166/250 |
| 4,207,765 | 6/1980 | Kiff | 73/151 |
| 4,265,110 | 5/1981 | Moulin | 73/151 |
| 4,289,024 | 9/1981 | Basham et al. | 73/151 |
| 4,351,186 | 9/1982 | Moulin | 73/151 |
| 4,515,010 | 5/1985 | Weido et al. | 166/255 X |
| 4,708,204 | 11/1987 | Stroud | 166/65.1 X |

FOREIGN PATENT DOCUMENTS 55-27974 2/1980 Japan .

*Primary Examiner*—William P. Neuder
*Attorney, Agent, or Firm*—Richards, Medlock & Andrews

[57] ABSTRACT

The present invention relates to the free point tool and a sensor for assembly for use in the free point tool. The sensor assembly comprises a first housing having an axis in a transmitter coil mounted thereon as well as at least one receiver coil. The axis of each coil is substantially parallel to the axis of the first housing. The second housing is movably attached to the first housing such that it can move along the axis of the first housing and also rotate about the axis of the first housing. The second housing carries the sensor plate which is located operatively adjacent to the receiving coils. Movement of the plate relative to the receiving coils changes the output of the receiving coils.

12 Claims, 5 Drawing Sheets

DEVICE TO DETERMINE FREE POINT

TECHNICAL FIELD OF THE INVENTION

The invention relates to a tool that can be used in oil and gas well operations and in particular a tool to determine the free point of pipe and casing within a well bore.

BACKGROUND OF THE INVENTION

When drilling wells pipe frequently becomes stuck in the well, which hinders further drilling operations. This will stop the drilling. To continue drilling, the drill string needs to be freed or removed. If this cannot be done, the well must be abandoned and a new well started. Thus, the most economical approach is to remove the free drill pipe and loosen the stuck pipe so that it can be removed, and a new drill pipe inserted. Thus, it is desirable to be able to ascertain as near as possible the location where the drill pipe is stuck so that the free pipe above the stuck portion can be recovered and the stuck portion can be loosened and recovered. Free point tools are used to locate the "free point" that point in the pipe string just above where the pipe is stuck. The stuck pipe can either be casing pipe or tubing pipe.

In the past a number of apparatus have been developed for determining free point. These devices usually located the free point by determining stresses in the pipe which would indicate whether the pipe was free or was stuck at certain locations. Many of these prior tools required two trips or more down the well in order to make an accurate determination of the free point.

Also, it is common in free point operations to attach to the free point tool an explosive charge called a string shot. This charge is positioned across the lowest free collar. The drill pipe is torqued with left hand torque and the string shot fired. After the pipe has been backed off by the explosive charges, the free pipe can be removed from the well. Thereafter, typically washing operations are conducted to free up the previously stuck pipe and allow its removal. Detonation of these explosive charges creates a great deal of stress on the free point tool. Previous free point tools normally contained oils and were pressurized to achieve a pressure balance. This use of oils in the tools created maintenance headaches, potential for leaks and possible contamination. Further, many times the tool apparatus was damaged or destroyed by detonation of the cutting charge (string shot) suspended below the device. Alternatively, the tool had to be recovered and the explosive charge sent down separately, which not only required an additional trip down the well bore, but also was subject to improper placement of the charge. Some prior tools could not independently measure torque and stretch. Many had the limitation that they could only take torque measurements in one direction.

A free point tool should be small so that it can pass through the special parts of the drill stem that has reduced internal diameter. The tool should be able to withstand high temperatures and work when in a non-vertical position. The tool should be easily transportable by helicopter. The tool should also be tough enough to survive the shock of detonation of a string shot. Prior to the present invention, free point tools were constructed in two parts with sensors mounted in between. These designs are oil filled to balance pressure. Thus, damage to the sensors and oil seals frequently resulted in damage from high temperature and also by absorbing the shock of the string shot.

Thus, there has been a continuing need to provide an improved free point locating tool. The present invention is advantageous in that it eliminates many of the moving parts of previous tools, simplifies construction, does not require use of oil or other fluid to achieve pressure balance so that the tool will operate. The tool of the present invention is also easily assembled and disassembled for transportation to the job site, is less prone to damage caused by detonation of an explosive charge suspended below the tool, and can be made in smaller diameters than are possible with current tool design.

The free point tool of the present invention has the advantages:

(a) it can make independent measurement of torque and stretch;

(b) it can read both left and right hand torque;

(c) it has good resolution;

(d) it has a linear signal and a wide range;

(e) it is relatively free of error induced by temperature;

(f) it is rugged and able to withstand repeated back off shots;

(g) it can be disassembled for transport;

(h) the tool as assembled is essentially a one piece main body with a movable sensor sleeve over a portion of the main body;

(i) it has a sensor sleeve that requires very little force to operate; and (j) it has a construction that will allow a lot of weight to be suspended on the bottom of the tool without inducing a measurement error.

SUMMARY OF THE INVENTION

In one aspect the present invention relates to a sensor assembly for use in a free point tool. The assembly comprises a housing defining an axis, with at least one receiver coil having an axis mounted on the sensor housing, and a transmitter coil having an axis mounted on the first housing. Movably attached to the housing is a sleeve, which is movably attached to the first housing. Mounted on the sleeve is a sensor plate. The sensor plate is mounted on the sleeve in an area operatively adjacent to the area of the housing at which the receiver coil(s) are mounted. The sensor plate is positioned adjacent to the receiver coil oriented such that movement of the sensor plate will affect the current fields in the receiver coil(s) mounted on the housing.

In another aspect, the present invention relates to a free point tool which has a housing having a first and second end and having an axis therethrough. Mounted on the housing at the first end is a first latching mechanism. A transmitter coil having an axis is mounted on the housing proximate the second end of the housing. The transmitter coil has an axis and the coil is located such that its axis is substantially parallel to the axis of said housing. One or more receiver coils are also mounted on the housing. These coils have an axis and the axis of the coil is positioned such that it is substantially parallel to the axis of the housing. The receiver coils are located operatively adjacent to the transmitter coil such that a current applied to the transmitter coil will induce a current in the receiver coils. A sleeve is movably attached to the housing. The sleeve defines an axis therethrough. A sensor plate is mounted on said sleeve in a position such that it is operatively adjacent to said receiver coils such that movement of the sensor plate will affect the signal output of the receiver coils as the sensor plate moves relative to the transmitter coils. A second retractable latching mechanism is mounted on the second end of the housing.

In the preferred embodiment, the housing and sleeve are made from a metal such as stainless steel with low Mu values. The sensor plate is made from a material having a higher Mu value (magnetic flux permeability) than the material used to construct the housing and sleeve. Mu refers to relative permeability. Relative permeability is the ratio of the magnetic flux in any element of a medium to the flux that would exist if the medium were replaced by air, the mmf (magnetomotive force) acting on the element remaining unchanged. Alternatively, the sensor plate can be made from a conductive material which produces eddy currents that affect the coil array in a manner to affect the signal of the receiver coils. Such conductive materials include copper, silver and gold. The plate is sized and dimensioned such that its movement relative to the receiving coils will cause the signal output from the receiving coils to change. In the preferred embodiment, a balanced coil is used for the receiver coil. Preferably, two receiving coils are used so that both stretch and rotation (torque) may be simultaneously measured by the tool.

In one embodiment, the present invention relates to a unique structure for providing a movable sensor sleeve over the housing. The apparatus consists of a housing with the first and second end, the second end of said housing has a reduced diameter. Positioned over a section of the reduced diameter portion of the reduced housing is an inner sleeve which is slidably disposed over the housing. The inner sleeve has first and second end, said second end having a retention mechanism for retaining strain. Over a portion of said second end of the inner sleeve is a spring having a first and second end. Second end of said spring rest against the restraining mechanism attached to the second end of said inner sleeve. Disposed over the portion of the inner sleeve at its first end which is slidably disposed over the inner sleeve. The outer sleeve defines passageways there through. Pivotably attached to the sleeve are two or more latching arms that would pass through said passageways. The latching arms also engage a channel on the interior of the inner sleeve. The inner sleeve is connected to a motor which moves the sleeve along the axis of the housing. Movement of the inner sleeve in combination with the action of the spring and the latching arm interaction with the inner sleeve and the sleeve allow for extension and retraction of the latching arms.

In yet another aspect the present invention relates to an arming circuit and device for arming a string shot attached to the free point tool. A micro switch is attached to a shaft. The shaft interconnects a motor with the lower latching arms. After the lower latching arms have been retracted, the switch is positioned such that further movement of the shaft and the retracting position will initiate the switch, arming the circuit. The circuit includes a cap at the string shot which is shunted. Disposed between the cap and the micro switch is one or more diodes. Preferably two or more diodes are utilized for purposes of redundancy to provide a margin of safety. When the micro switch is closed, the circuit is completed between the cap and the operators console on the surface. Application of negative voltage to the circuit will then allow the cap to be initiated.

BRIEF DESCRIPTION OF THE DRAWINGS

A more complete understanding of the invention and its details and advantages will be apparent from the following detailed description taken in conjunction with the accompanying drawings, in which.

DETAILED DESCRIPTION

Figure 1:
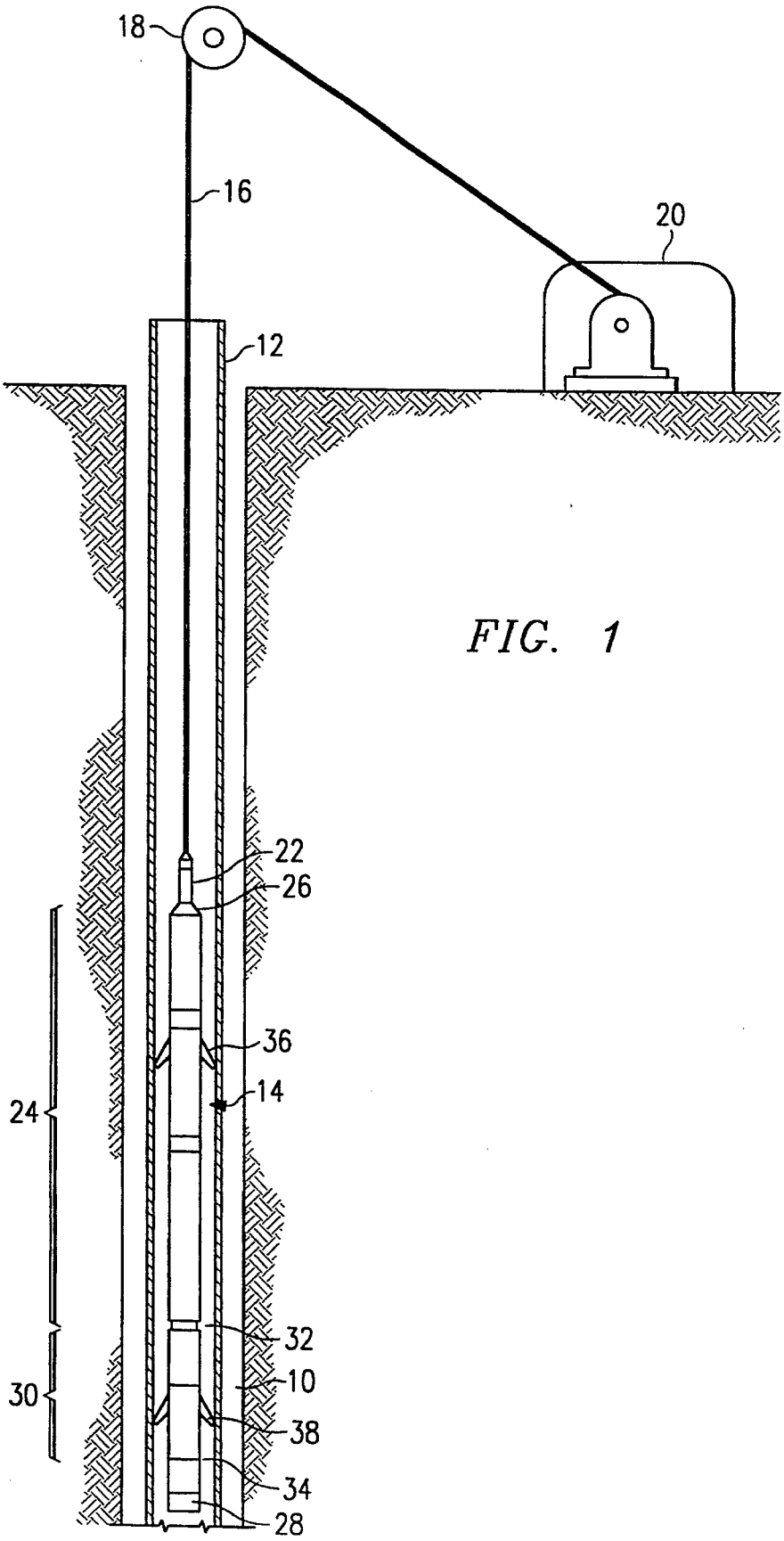
FIG. 1 is a picture of the free point tool shown in place in a cross-sectional view of a well bore.

FIG. 1 shows a well 10 having a casing 12. The free point tool generally indicated as 14 is suspended on wire 16 which extends over sheave 18 to wire line service unit 20. Wire line service unit 20 permits lowering and raising of the tool 14 in casing 12. Also, servicing unit 20 has the necessary electrical controls and instruments to control operation of the free point tool and to read signals generated by the tool. In the drawings, like members refer to like components.

Free point tool 14 is suspended from wire 16 by wire socket 22. Tool 14 has a first housing 24 having a first end 26 and a second end 28. Movably attached to first housing 24 is sleeve 30 having a first end 32 and a second end 34. As is discussed in more detail below and in the other drawings, housing 24 and has a reduced diameter section over which sleeve 30 is positioned. In operation, the free point tool 14 is lowered into the casing 12 to the desired position. Once the tool is in proper position, then the first set of retractable latches 36 mounted on first housing 24 are extended to fix the first housing 24 in position in the casing 12. Also, a second set of retractable latches 38 pivotably attached to sleeve 30 are extended so that they contact casing 12. Retractable latches 36 and 38 hold the free point tool 14 in a fixed position with respect to the casing 12. The casing 12 is then stretched and rotated. This will cause the casing 12 in the vicinity of the free point tool 14 to also stretch and rotate unless the casing is stuck. By measuring the rotation and stretch of the casing in the area where the free point tool is positioned, one may determine whether the casing adjacent to the free point tool is stuck or whether it is free. Those portions of the casing above the first location where the casing is stuck will stretch when the top of the casing at the well-head is pulled upward. Also, the free portion of the casing will rotate when torque is applied at the top of the well head. The free point tool 14 will detect this stretch and rotation (torque) indicating the portion above the tool is free. If no stretch or rotation is detected, then the casing is struck at a location above the tool. By moving the tool along the casing, one can determine the point above which the casing is free.

Thereafter, an explosive charge can be detonated in the area immediately above the point where the casing is stuck and the free casing removed. Usually this is done by placing the charge at a first collar above the free point. Once the free portion of casing (pipe or tubing) is removed, wash over operations can be used to free and remove the stuck portion.

Figure 2:
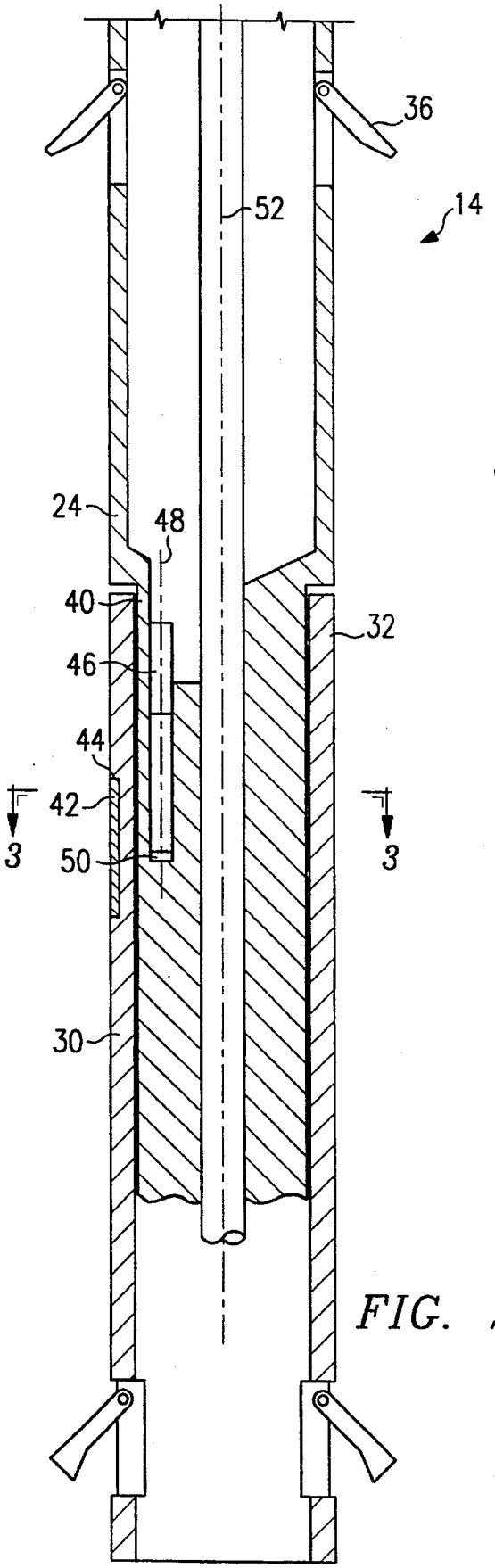
FIG. 2 is a simplified cross-sectional view of the free point tool.

FIG. 2 is a simplified partial cross-section of the free point tool 14 at the location where the housing 24 and sleeve 30 overlap. The housing 24 has a reduced diameter 40 which telescopes inside the first end 32 of sleeve 30. Attached to sleeve 30 is sensor plate 42, as shown sensor plate 42 is mounted in a cavity 44 in sleeve 30. Mounted on the housing 24 is a transmitter coil 46 and one or more receiver coils (not shown). Shown in FIG. 2 cross-section is transmitter coil 46. Transmitter coil 46 has an axis 48 therethrough. Transmitter coil 46 is preferably mounted in transmitter coil chamber 50 in the second end 28 of said first housing 24.

The axis of the transmitter coil 46 and the receiving coils (not showing in FIG. 2) is substantially parallel to axis 52 of the first housing 24.

Figure 3:
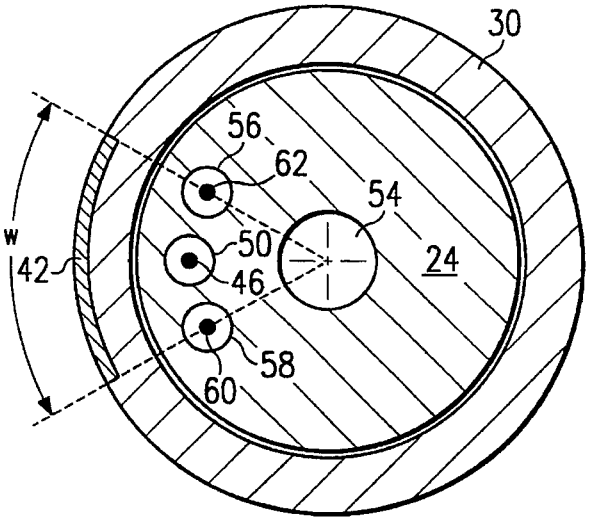
FIG. 3 is a cross-sectional view of the free point tool of FIG. 2 along line 3—3.

FIG. 3 is a cross-section review of the free point tool 14 along line 3—3 in FIG. 2. The operating relationship between the coils and the sensor will be better understood in reference to FIGS. 3 and 4. As shown in FIG. 3, the outer wall of sleeve 30 surrounds the reduced diameter portion 40 of housing 24. Housing 24 has a passage way therethrough 54 in which electric conductors are placed in order to connect electrical components of the second housing 30, such as, motors operating the latching mechanism mounted on the second housing and for other purposes as is known in the art. Housing 24 contains a transmitter coil chambers 50 and two receiving coil chambers 56 and 58.

Contained within chambers 50, 56 and 58 is transmitter coil 46, first receiving coil 60 and second receiving coil 62. Preferably transmitter coil 46 is placed in between first and second receiver coils 60 and 62. It is preferred that the axis of each receiving coil be equidistant from the axis of the transmitter coil. Preferably the axis of transmitter coil 46 is substantially parallel to the axis of first receiver coil 60 and second receiver coil 62. However, spacing of the coils may be different. Also, the axis of each receiver coil and the transmitter coil should be substantially parallel to the axis of the first housing 24.

Mounted on sleeve 30 is sensor plate 42 in a location which is operatively adjacent to the first and second receiver coils 60 and 62. Sensor plate 42 may be of any material which will concentrate magnetic flux lines to a greater extent than the material used to make second and first housings. Operatively adjacent as used here means that sensor plate 42 is positioned in relation to the receiver coils such that movement of the sensor plate will cause a charge in the signal output of the receiving coils as a result of the movement of the sensor plate in relation to the coil.

Sleeve 30 is movably attached to housing 24 such that it may rotate about the axis 52 of the first housing 24 and also move laterally along the axis 42 of the housing 24. Movement of the sleeve 30 will result in the moving of sensor plate 42. The size and shape of sensor plate 42 is a matter of choice. It is important that the sensor plate be sized and positioned such that it is operatively adjacent to first and second receiver cords. Operatively adjacent indicates that movement of the sensor plate either rotationally about the axis 52 and thereby about the receiver coils will cause a change in the single output of the receiver coils. Likewise the movement of sensor plate 42 along the length of axis 52 and thus along the axis of the receiver coils will also effect output signals by the receiver coils.

Preferably, sensor plate 42 has a width "W" less than the arc bounded by lines drawn through the axis of 52 of first housing 24 and the axis 64 of the first receiving coil 60 and the axis 68 of the second receiving coil 62. The length ("h") of the sensor plate is preferably equal to or less than the length ("l") of the receiving coils. (See FIG. 4) The shape of the sensor plate is not critical as long as the movement of the sensor plate adjacent to the receiving coils will affect the output of the sale from the receiver coils. For convenience, the sensor plate 42 has been shown as square or rectangular but other shapes will also work. A sensor plate made of Mumetal W=0.5 inch and h=0.5 inch and 0.006 inches thick has been found useful when used with receiving coils 0.2 inches in diameter and 0.5 inches (l) in length.

The receiver coils can be a wound coil of electrically conductive material such as copper. The coils can be if desired wrapped around a supporting core, such as a stainless supporting steel rod.

Preferably, receiver coils 60 and 62 are of balanced coil design. A balanced coil is one in which one half of the coil is wound in one direction and the other half of the coil is wound in the opposite direction. Preferably the winding is of copper of other highly conductive metal. It is not necessary for the receiver coils to be wound around a core, but it is preferred. Preferably, the copper is wound around a core of Mumetal which helps concentrate the magnetic flux lines in the receiver coils. Use of a Mumetal core or other metal having a high Mu value is very desirable in smaller tools, i.e., tools having outside diameters as small as ⅝ of an inch.

Preferably, the sensor plate is made of Mumetal. Mumetal is an alloy comprised of 14% iron, 79% nickel, 5% copper and 2% chrome. Mumetal is desirable because it has a high permeability at low flux densities (referred to herein as Mu value). Other suitable metals having a high Mu value for flux include 16 Alfenol (16% Al, balance iron); 78 Permalloy (78.5% Ni, balance iron); Supermalloy (5% Mo, 79% Ni, balance Fe); and Hipernik (50% Ni, balance iron). Other alloys may also be used which have a high flux permeability at low flux densities. These types of alloys are frequently used for magnetic shielding and cores for magnetic amplifiers.

In construction of the housing and sleeve, use of stainless steel is preferred and titanium may be used. These materials are desirable because the Mu value is approximately 1.001 (1 being the lowest Mu value possible). Thus, this allows use of a great many materials for the sensor plate because it will be easy to obtain a difference in the Mu value between the sensor plate and housing. Stainless steel has a low Mu factor in comparison to Mumetal and other alloys exhibiting high flux permeability. It is important that there be a difference in the flux permeability; otherwise, the sensor plate movement would not cause any variation in the signal output of the receiving coils. Alternatively but less desirable is that both the sensor plate could be made of a material having a much lower Mu value than the housing and sleeve surrounding it. The differential in Mu value between the sensor, housing and sleeve allows the movement of the sensor plate to change the output of the coils. It is not required that Mumetal be used as long as the sensor plate has a high enough permeability at low flux densities to affect the output signal of receiver coils 60 and 62 as it moves in relation to the coils.

Although use of materials with a good Mu value is preferred for the sensor plate, the sensor plate may also be made of a good conductive material. Good conductors produce eddy currents that affect the coils in such a way that movement of the conductor in the proximity of the coils produces changes in the output signal of the receiver coils that can be measured. Such materials include, for example, copper, silver, and gold.

Figure 4:
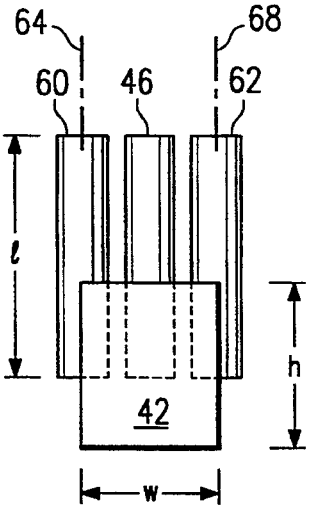
FIG. 4 is depiction of the receiving coils, and transmitter coils with the sensor plate superimposed to show how movement of the plate affects signals from the receiver coils.

FIG. 4 is a simplified view of the transmitter coil 46 and first and second receiver coil 60 and 62 which sensor plate 42 positioned in front of them. As sensor plate 42 moves to the left, the signal from receiver coil 60 will increase and the signal in receiver coil 62 will decrease. When such a plate 42 moves up in relationship to the receiver coils 60 and 62, the signal in both coils increases. By summing, signals received from coils may be used to determine movement along the length of axis 52, and by taking the difference in the signals between coil 60 and 62 one can determine torque or radial movement.

Figure 5:
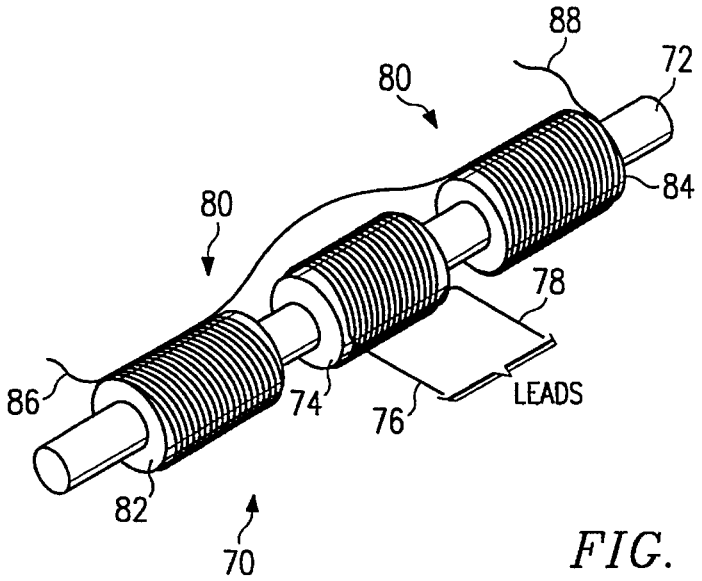
FIG. 5 is a view of an alternate coil embodiment.

More than one transmitter coil may be used. The coil arrangement can also be in other configurations. For example, coil assembly 70 of FIG. 5 consists of a core 72 with a transmitter coil 74 wrapped around the midpoint having leads 76 and 78 and a receiver coil generally indicated as comprising a first coil portion 82 and a second coil portion 84 wound in opposite directions to provide a balanced receiver coil 80. Receiving coil 80 may be connected by leads 86 and 88. Thus, the transmitter coil is positioned between two halves of a receiver coil. Two of the coil assemblies 70 may be used and eliminate the need for a separate transmitter coil mounted on a separate core.

First and second latching mechanisms 36 and 38 may be of any suitable design. Preferably, they are electrically powered and activated arms which can be rotated from a withdrawn position in the side of tool 14 into contact with the pipe when it is desired to position the tool to take a measurement. Mechanisms 36 and 38 are retracted when it is desired to move the tool. Other latching mechanisms such as electro magnets, bow springs and other latches known in the art may be used.

Figure 6:
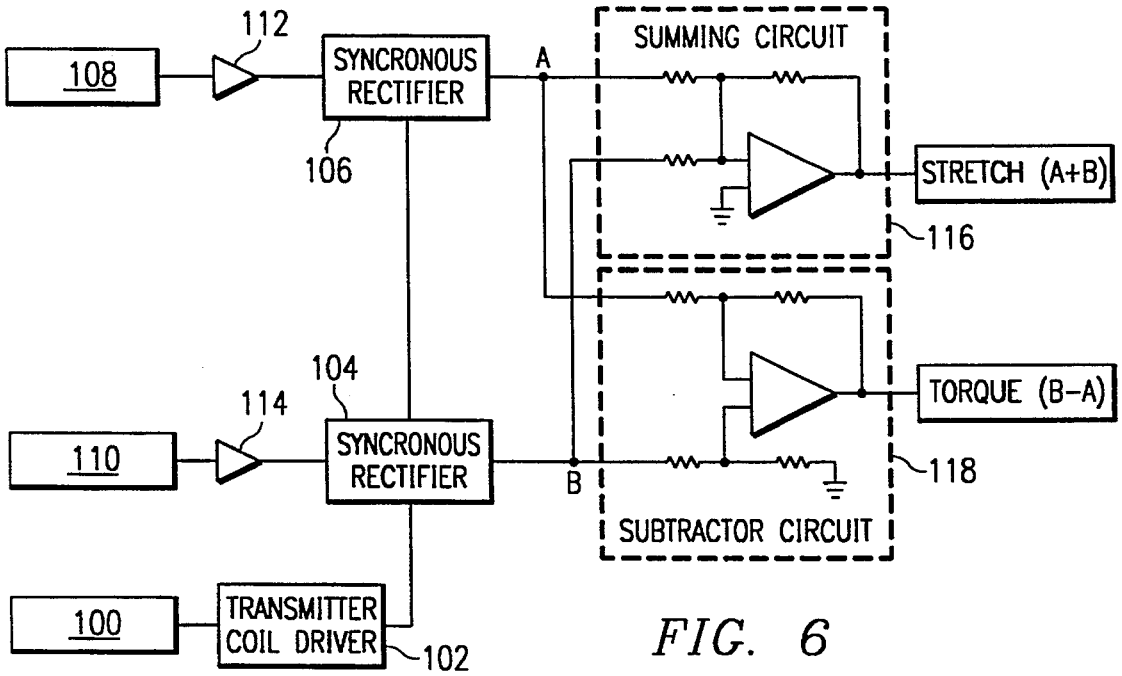
FIG. 6 is a circuit diagram for the processing of signals from the receiver coils.

FIG. 6 shows a circuit diagram for processing signals received from the coils. Transmitter coil 100 is connected to a transmitter coil driver 102 which is attached or connected to synchronized rectifiers 104 and 106. When transmitter coil 100 is energized, current is induced in first receiver coil 108 and second receiver coil 110. The current generated will be a function of the location of the sensor plate (not shown in FIG. 7) in relation to the first receiver coil 108 and the second receiver coil 110. First receiver coil 108 signal output is connected to amplifier 112 and output of receiver coil 110 is connected to amplifier 114. The output of coil 108 is represented by A and the output of receiver coil 110 is represented by B. The circuit 116 determines stretch by adding the signals from first receiver coil 108 and second receiver coil 110. Circuit 118 determines torque or the twist of the pipe by subtracting the signal generated by second receiver coil 110 from that generated by first receiver coil 108. Alternatively, the signal from coil A may be subtracted from coil B.

In the preferred embodiment the tool 14 has an indexing and locking mechanism which places the sensor plate in an initial zero position. Preferably the initial position is best suited for achieving a base signal from the receiving coils to use as a datum for evaluation of changes in receiver coil output.

Figure 7:
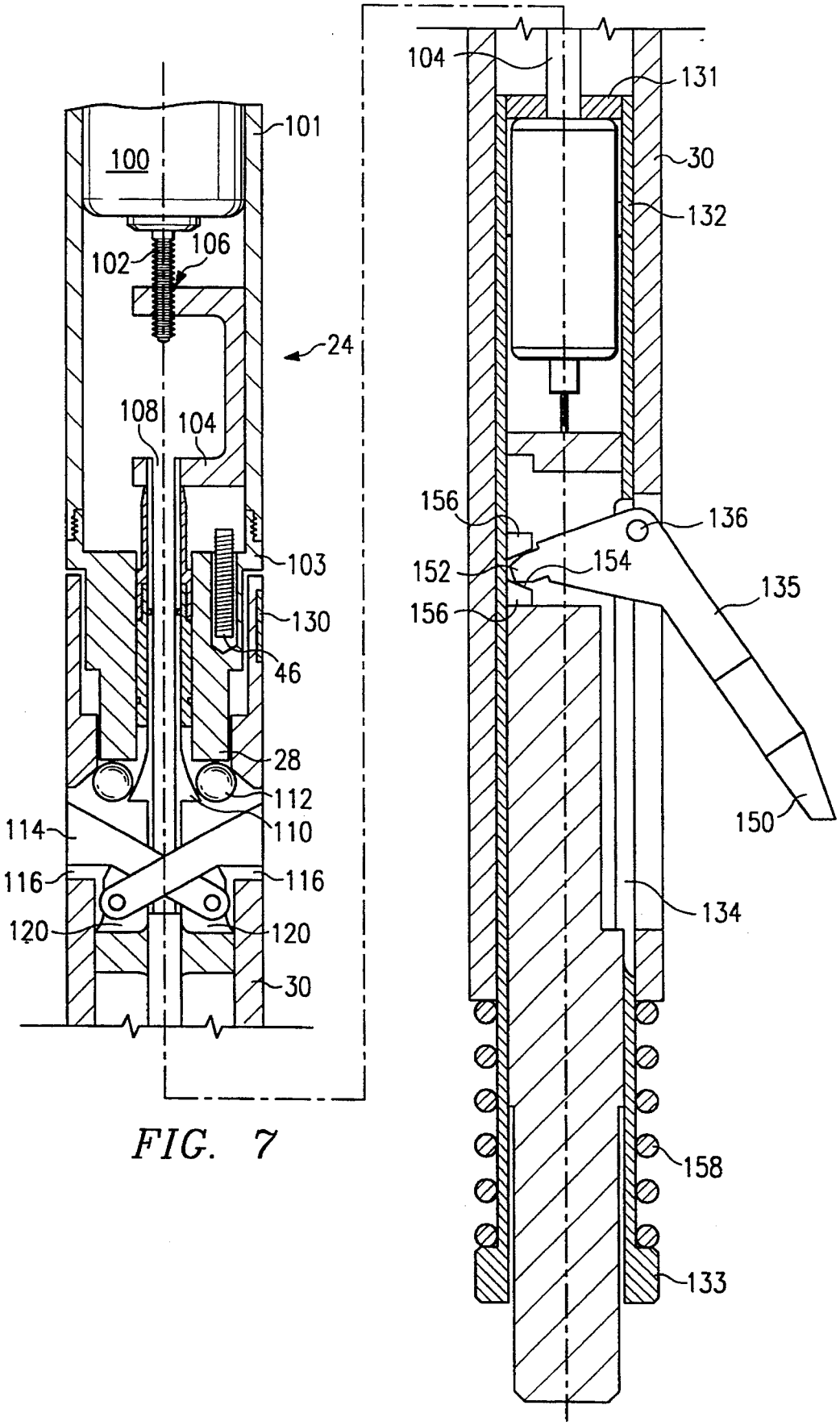
FIG. 7 is a more detailed cross section of the tool in the area of the sensor section.

FIG. 7 is a simplified cross section of a portion of a tool constructed in accordance with the present invention illustrating the principles of the locking mechanism. Housing 24 has mounted within it motor 100. Motor 100 has a threaded shaft 102 extending therefrom. Disposed within housing 24 is lower section support shaft 104. At the first end of support shaft 104 is a threaded passageway 106 which engages threads on motor shaft 102. By activating motor 100, thereby rotating shaft 102 the position of the sleeve 30 with respect to the housing 24 can be varied. Movement of shaft 104 causes movement of sleeve 30. Support shaft 104 also defines a passageway 108 extending therethrough to allow passage of electrical conductors. The reduced diameter section of housing 24 supports locking hammers 114. Locking hammers 114 pass through hammer openings 116 in sleeve. The lower end 131 of shaft 104 is attached to the first end of inner sleeve 132. The second end of inner sleeve 132 is threaded and received spring retaining nut 133. Inner sleeve 131 has an opening 134 through which lower latching arm 135. Latching arm 135 at a midpoint is pivotably attached to sleeve 30 by pivot pin 136. The first end 150 of latch arm 135 will contact the inside of the tubing when extended. The second end 152 of latch arm 135 slidable engages channel 154 on the inside of inner sleeve 132 formed by projection upper and lower projections 154 and 156.

Thus, when shaft 102 is rotated such that shaft 106 moves away from motor 100, the inner sleeve moves in the same direction. As a result, spring 158 expands pushing sleeve 30 away from nut 133 thereby causing arm 135 to rotate such that its first end 150 extends away from the tool. Also asserting in the movement is the interaction of the second end 152 of arm 135 with channel 154. Arm 135 is closed by turning shaft 102 such that shaft 106 moves towards motor 100. This causes inner sleeve 132 to move in the same direction, thereby causing lower project 154 to push the second end 152 of arm 135 towards the motor 100 and retracting arm 135 into the tool. (only one latching arm is shown, although it is understood that two or more arms are used for each latching mechanism).

Figure 8:
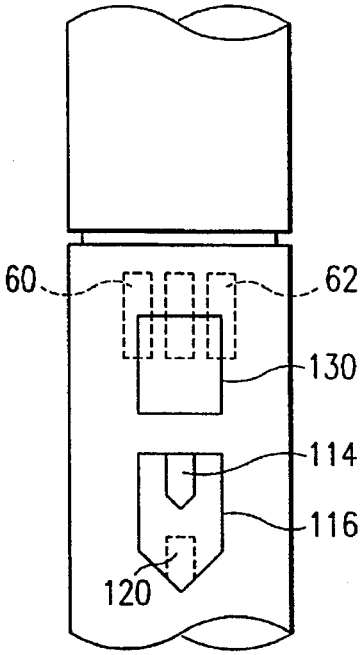
FIG. 8 is a side view of the zero mechanism.

In preparing the tool for a trip down the pipe, motor 100 is activated to draw shaft 104 towards the motor 100 thereby causing sleeve 30 to move towards the motor 100 and causing hammers 114 to contact the bottom of the hammer openings 116 (position 120 shown in phantom see FIG. 8). The opening 116 preferably has a V-shaped bottom 117 so that the hammers 114 interacting with the bottom V will cause alignment in the initiating or zero position of the sensor plate over the receiving coils 60 and 62. Thereafter, the tool can be lowered into the well with the latching mechanisms 38 retracted into the sides of the tools. At a predetermined depth, the upper latching arms are opened and the first housing section is secured to the pipe. Thereafter, the second latching mechanisms are extended affixing the sleeve to the interior of the pipe. Motor 100 is activated to release the locking action of the hammer thereby freeing the sleeve to move with respect to the first housing in response to deformation of the pipe. The signals from the receiving coils are zeroed. Stretch and torque are then applied to the pipe at the top of the well through the drilling rig. If the pipe is in a section above the stuck zone, the pipe will stretch and twist in response to pulling and the application of torque. This movement will be transmitted to the tool 14 through the upper and lower latching mechanisms 36 and 38 and the housing will move with respect to the sleeve. As the sensor plate position moves from its initial position to a second position, the change in signals in the receiving coils will allow computation of stretch and torque. When the tool is positioned in a portion of the string below the stuck point of the pipe, there will be no change in signal or very minor change because the stretch and torque forces will not be transmitted in the pipe beyond the stuck point.

Figure 9:
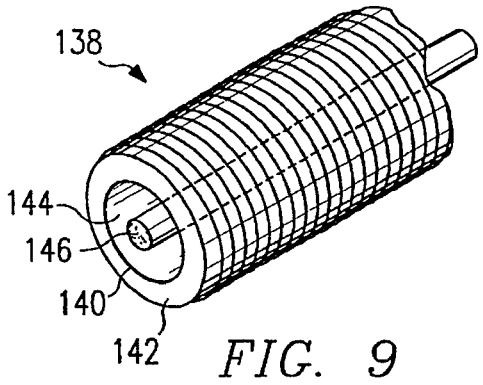
FIG. 9 is a perspective view of the preferred coil construction.

In a preferred embodiment, the coils are constructed as shown in FIG. 9. In FIG. 9 the coil 138 comprises a stainless steel mandrel 140 defining a passageway 144 therethrough. Wrapped around the steel mandrel 140 is a conductive wire 142 such as copper wire of small diameter. Inside passageway 144 is a center core 146 with a high flux permeability inserted therein. This center core material may be Mumetal or other alloys which have a high permeability to magnetic flux and thereby concentrating flux lines. Preferably the material used for the core has a Mu value of 2 or more. With this construction, holes can be made in very small sizes, for example 0.25 inch or less, while still possessing the ability to produce a signal 20% or stronger than the signal from a similar coil without a high flux permeability center core. The construction of the present invention provides an extremely durable sensor assembly for free point tools. Each coil is a winding of conductive wire supported on a core made of a stainless steel mandrel with a center core of a material with a Mu value of 2 or more. Each coil is inserted into a stainless steel receiving chamber. The sensor plate is a high magnetic flux density alloy and very tough. If desired, it can also be covered by a protective plate material such as titanium metal. The tool has no fluid or oil thus the tool produced is very tough and able to withstand detonation of the typical 560 grams per foot charge of high explosive used in backing off procedures. Also, the tool easily stands elevated temperatures in the boreholes.

In operation the tool is locked into the indexed position 120. The tool is suspended in the desired location along the drill stem. Typically, the drill stem will be pulled or lifted such that the weight of the pipe above the free point tool is lifted. This is typically done by calculation. The latches of the tool are then engaged with the wall of the pipe. The meters reading output from the receiver coils are electrically zeroed. The tubing is then stretched. If the free point tool is located above the point where the pipe is stuck, the movement of the sensor plate will cause an indication (change in signal) on the meters which reflects the movement of the sensor plate in relation to the receiving coils. The drill stem is then lowered and set up to apply torque. Meters are reset if necessary. Torque is applied to the tubing. If the tubing is above the free point, the tubing will rotate thereby producing a signal on the meters which can be read.

Although the invention has been described with some particularity in regard to the preferred embodiment, it is understood that the present disclosure is made only by way of example and that numerous changes in the details of construction, and that the combination of arrangement of elements, may be made without departing from the spirit and the scope of the invention as herein defined.

In another aspect, the present invention relates to a motorized arming circuit for the explosive detonator for the string shot which may be attached to the bottom of the free-point tool. Accidental detonation of such charges, if exposed to unintended or unknown voltage sources is a concern. This invention decreases the likelihood of accidental detonation regardless of voltages applied to other components of the tool. Usually the string shots are detonated by electric blasting caps. In construction this tool shunts the detonator (i.e. grounded) and does not connect the detonator to any circuit of the tool or wire line until the operator commands arming. Another feature of the invention is that the operator cannot command arming until the lower latching arms are in the closed position. This avoids damage to the tool latching mechanisms because they are not in contact with the inside wall of the pipe.

Figure 10:
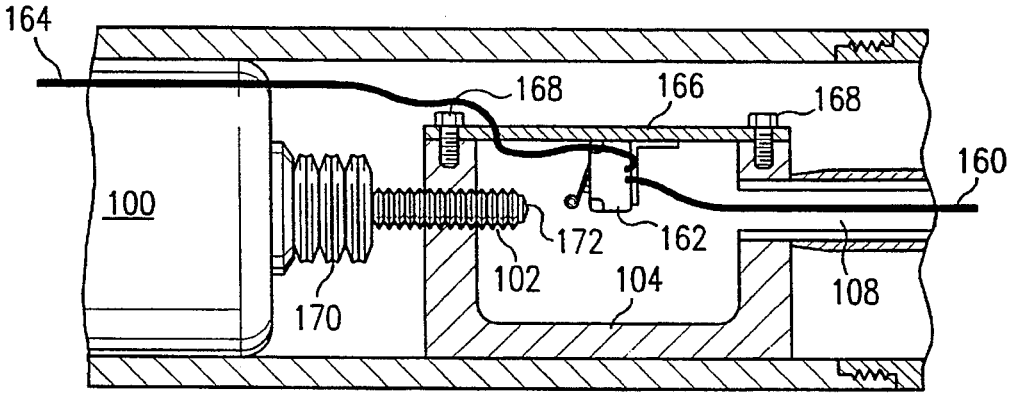
FIG. 10 is a cross sectional view of the tool at the location of the switch for the arming of the string shot.

Referring to FIG. 10 as showing a simplified cross-section of the arming mechanism. Conductor 160 leads down passageway 108 through the toolhousing and is connected to the electric detonator of the string shot. Conductor 160 is connected to the microswitch 162 which is connected to the surface via conductor 164. Microswitch 162 is mounted on plate 166 which is attached to shaft 104 by screws 168. To arm the circuit, motorshaft 102 is rotated such that shaft 104 moves towards motor 100. As explained above this will cause the lower latching arms to retract into the tool. When shaft 104 contacts spring 170 the arms will be fully closed. The tip 172 of the shaft at that point will not touch microswitch number 162. To activate switch 162, shaft 102 is rotated such that shaft 104 will compress spring 170. Thereby carrying switch 162 into contact with the tip 172 of the shaft 104 thereby activating the switch and connecting the electric detonator to the surface. In the mechanism spring 170 is not required, however it is desired because it resists the movement of the shaft 104 preventing unintended arming of the circuit.

Once microswitch 162 is closed, the blasting cap is connected to the surface through diodes that will pass only a negative firing voltage. This greatly minimizes the risk of accidental detonation even after the circuit is armed.

Figure 11:
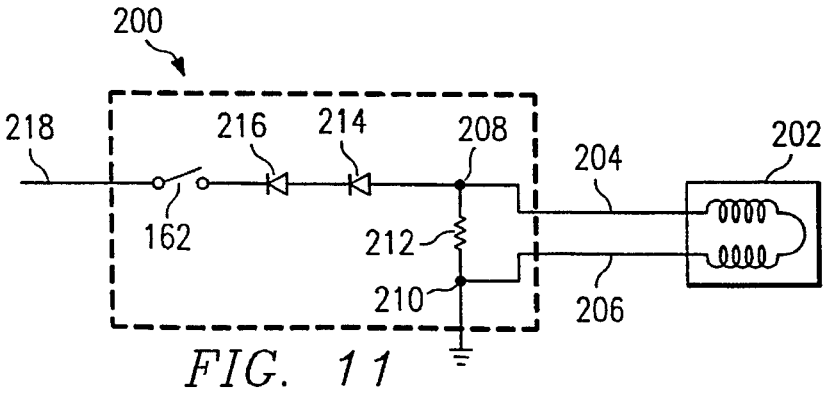
FIG. 11 is a circuit diagram of the arming circuit for the string shot.

FIG. 11 is a schematic diagram of the firing circuit generally indicated as 200. Attached to circuit 200 is electric blasting cap 202 of conventional construction. Blasting cap 202 is used to initiate the main explosive charge of the string shot (not shown). Cap 202 contains a electric "match" which heats when current is applied to initiate the small explosive charge contained within the Cap 202. Cap 202 has two leg wires 204 and 206. Leg wires 204 and 206 are connected to first and second cap terminals 208 and 210. Interposed between terminal 208 and 210 is resistor 212. The other side of terminal 210 is grounded. As a result the Cap 202 is shunted (grounded) so that stray electrical currents will not initiate the Cap 202. The side of terminal 208 opposite resistor 208 is connected to first diode 214 and second diode 216 in series. Diode 216 is connection to microswitch 162. The preferred embodiment utilizes two or more diodes in series between the cap terminals and the microswitch. However, one diode will work, but redundancy is preferred for safety reasons.

Switch 162 is connected to the surface via conductor 218. Initially conductor 218 carries positive voltage as do the other circuits of the tool. When switch 162 is closed the positive voltage will not pass through the diodes 214 and 216, thus no current flows to cap preventing unintended detonation. When it is desired to detonate the cap, a negative voltage is applied to conductor 218, as a result current will flow from terminal 210 through the cap and diodes resulting in initiation of the cap.

I claim:

1. A sensor assembly for use in a free point tool comprising:

a first housing defining an axis;

at least one receiver coil having an axis mounted on said first housing, the axis of said receiving coil being substantially parallel to the axis of said first housing;

a transmitter coil having an axis mounted on said first housing, the axis of said transmitter coil being substantially parallel to the axis of said first housing;

a second housing movably attached to said first housing such that first and second housings may move laterally along the axis of the first housing and also that they may move relative to each other rotationally about the axis of said first housing; and a sensor plate attached to said second housing operatively adjacent to said receiver coils such that movement of the sensor plate in relation to said receiver coil will produce the change in the signal output of the receiver coil(s).

2. A sensor assembly of claim 1 wherein said housings are constructed of stainless steel and said sensor plate is a material with a high Mu value.

3. The sensor assembly of claim 1 wherein said receiver coils further comprise a conductive element wrapped around a core of high Mu value material.

4. The assembly of claim 1 wherein said receiver coils further comprise a stainless steel mandrel defining a passageway and having an axis, a conductive material wrapped around said mandrel forming a coil of conductive material and a material having a high Mu value located within said passageway of said mandrel.

5. The sensor assembly of claim 1 wherein said sensor plate has a Mu value much higher than the Mu value of said housings.

6. The sensor assembly of claim 1 wherein said sensor plate has a Mu value much less than the Mu value of said housings.

7. A free point tool comprising:

a) a first housing having a first and second end and having an axis therethrough;

b) a first latching mechanism mounted on said upper body housing;

c) a transmitter coil having an axis, mounted on said first housing adjacent said second end of said body, and positioned such that the axis of said transmitter coil is substantially parallel to the axis of said first housing;

d) at least one receiver coil having an axis mounted on said first housing adjacent said second end of said housing and positioned such that the axis of said receiver coil is substantially parallel to the axis of said first housing;

e) a second housing having a first and second end, said first end of said housing being movably attached to said second end of said first housing;

f) a sensor plate mounted on said second housing operatively adjacent to said receiver coil(s) such that movement of said sensor plate relative to said receiving coil(s) effects the signal output as it moves in relation thereto; and g) a second latching mechanism mounted on said second housing.

8. A sensor assembly of claim 7 wherein said housings are constructed of stainless steel and said sensor plate is a material with a Mu value.

9. The sensor assembly of claim 7 wherein said receiver coils further comprise a conductive element wrapped around a core of high Mu value material.

10. The assembly of claim 7 wherein said receiver coils further comprise a stainless steel mandrel defining a passageway and having an axis, a conductive material wrapped around said mandrel forming a coil of conductive material and a material having a high Mu value located within said passageway of said mandrel.

11. The sensor assembly of claim 7 wherein said sensor plate has a Mu value much higher than the Mu value of said housings.

12. The sensor assembly of claim 7 wherein said sensor plate has a Mu value much less than the Mu value of said housings.

* * * * *

UNITED STATES PATENT AND TRADEMARK OFFICE

CERTIFICATE OF CORRECTION

PATENT NO. : 5,520,245

DATED : May 28, 1996

INVENTOR(S) : Estes

It is certified that error appears in the above-indentified patent and that said Letters Patent is hereby corrected as shown below:

Item [73]
On title page, add "Assignee:" Wedge Wireline, Inc., Grand Prairie, Tex.

Signed and Sealed this

Thirty-first Day of December, 1996

*Attest:*

*Attesting Officer*

BRUCE LEHMAN

*Commissioner of Patents and Trademarks*